US005351978A

United States Patent [19]

Chen

[11] Patent Number: 5,351,978

[45] Date of Patent: Oct. 4, 1994

[54] DOUBLE-LOCK HEIGHT ADJUSTMENT APPARATUS FOR BABY WALKER

[76] Inventor: Jueh-Cheng Chen, No. 42, Hsin-Le Rd., Tainan City, Taiwan

[21] Appl. No.: 33,118

[22] Filed: Mar. 18, 1993

[51] Int. Cl.[5] ..... B62B 7/06

[52] U.S. Cl. ..... 280/87.051; 248/188.2; 297/5; 297/344.15

[58] Field of Search ..... 182/205; 248/188.2, 248/354.7; 108/118, 119, 148; 297/5, 344.15, 353, 411.36; 280/87.021, 87.05, 87.051

[56] References Cited

U.S. PATENT DOCUMENTS 908,387 12/1908 Boyd ..... 182/205
1,329,740 2/1920 Barron ..... 182/205
4,019,756 4/1977 Ishida ..... 297/5 X
4,168,669 9/1979 Arnoff ..... 108/119 X
4,433,869 2/1984 Payne, Jr. et al. ..... 297/5
4,576,392 3/1986 Quinlan, Jr. ..... 280/87.051
4,615,523 10/1986 Chen ..... 297/5 X

*Primary Examiner*—Karin L. Tyson
*Assistant Examiner*—Michael Mar
*Attorney, Agent, or Firm*—Rines & Rines Shapiro and Shapiro

[57] ABSTRACT

A height adjustment apparatus for a baby walker includes a first controlling member and a second controlling member which are associated with each other. The height of the baby walker can be adjusted only when rotation of first controlling member and movement of the second controlling member are effected.

1 Claim, 11 Drawing Sheets

DOUBLE-LOCK HEIGHT ADJUSTMENT APPARATUS FOR BABY WALKER

BACKGROUND OF THE INVENTION

1. Field of the Invention

This invention relates to a height adjustment apparatus for a baby walker, more particularly to a double-lock height adjustment apparatus.

2. Description of the Related Art

Referring to FIGS. 1 and 2, a conventional height adjustment apparatus for a baby walker (4) is disposed between a seat (41) and a U-shaped tube (42) and includes a positioning plate (1), a retaining member (2) and a controlling member (3). The U-shaped tube (42) has a radial hole (422) formed therethrough. The positioning plate (1) has a row of positioning holes (11) and four fastening holes (12) and is screwed to the underside of the seat (41). The retaining member (2) has a U-cross-sectioned body disposed around the upper portion of the U-shaped tube (42), and a slot (21) formed through the central portion thereof. Two lugs (22) project outward from one side of the body of the retaining member (2) and have central holes (221) formed therethrough. A fastening plate (23) projects outward from the other side of the body of the retaining member (2) and has two end holes (221') in two end portions thereof, and a middle hole (24) in the middle portion thereof. A positioning pin (421) is fixed in the hole (422) of the U-shaped tube (42) and extends through the slot (21) so as to position the retaining member (2) on the U-shaped tube (42). The controlling member (3) has a hollow projection (311) and four holes (312) (only two are shown in FIG. 2) formed therethrough in alignment with the holes (221, 221') of the retaining member (2) so that four lock bolts (not shown) extend through the holes (B12) of the controlling member (3) and the holes (221, 221') of the retaining member (2), thereby confining the U-shaped tube (42) between the retaining member (2) and the controlling member (3). Because the positioning plate (1) is positioned between two of the lock bolts that extend through the holes (221) of the retaining member (2) and between another two of the lock bolts that extend through the holes (221') of the retaining member (2), the assembly of the U-shaped tube (42), the retaining member (2) and the controlling member (3) is retained on and is slidable relative to the positioning plate (1) and the seat (41).

A movable lock pin (32) is mounted in the projection (311) of the controlling member (3) and is biased by a spring (321) to extend from the projection (311) and through one of the positioning holes (11) of the positioning plate (1) so as to engage the middle hole (24) of the retaining member (2). A pull member (322) is mounted on the projection (311) and is connected securely to the movable lock pin (32).

Referring to FIG. 3, when one desires to adjust the height of-the baby walker (4), the pull member (322) is pulled so as to disengage the movable lock pin (32) from the middle hole (24) of the retaining member (2) and from the positioning hole (11) of the positioning plate (1), thereby allowing movement of the movable lock pin (32) from one of the positioning holes (11) to another. Accordingly, the U-shaped tube (42) can be moved relative to the positioning plate (1) which is fastened to the seat (41) from the position of FIG. 3 to the position of FIG. 4 or 5.

Although the height of the baby walker can be easily adjusted, a baby carried thereon may pull the pull member (322), thus resulting in an abrupt downward movement of the seat or even in collapsing of the baby walker. As a result, the baby may get hurt.

SUMMARY OF THE INVENTION

The main object of this invention is to provide a double-lock height adjustment apparatus for a baby walker which can prevent effectively unintended height adjustment of the baby walker so as to increase the safety of a baby carried on the baby walker.

According to this invention, a height adjustment apparatus for a baby walker includes a first controlling member and a second controlling member which are associated with each other. The height of the baby walker can be adjusted only when rotation of the first controlling member and movement of the second controlling member are effected.

BRIEF DESCRIPTION OF THE DRAWING

Other features and advantages of this invention will become apparent in the following detailed description of a preferred embodiment of this invention, with reference to the accompanying drawings, in which.

DETAILED DESCRIPTION OF THE PREFERRED EMBODIMENT

Figure 1:
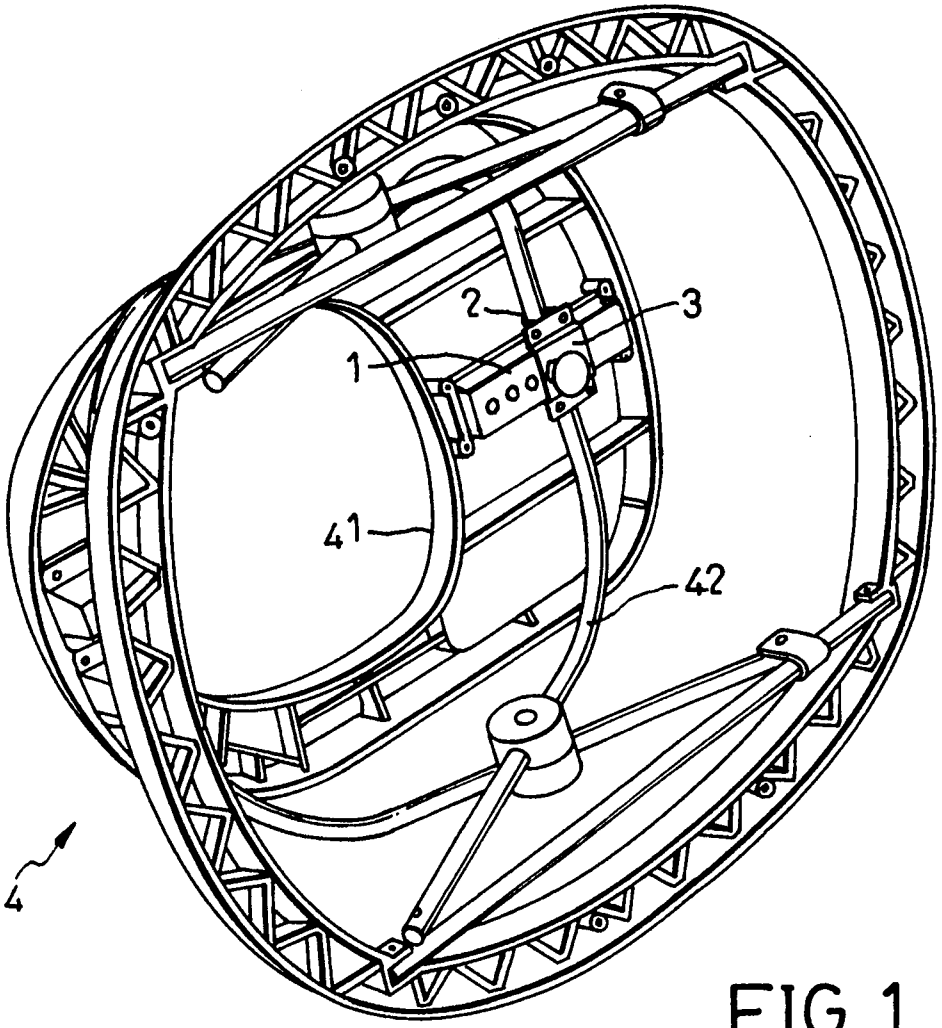
FIG. 1 PRIOR ART
FIG. 1 is a rear perspective view of a conventional baby walker.
Figure 2:
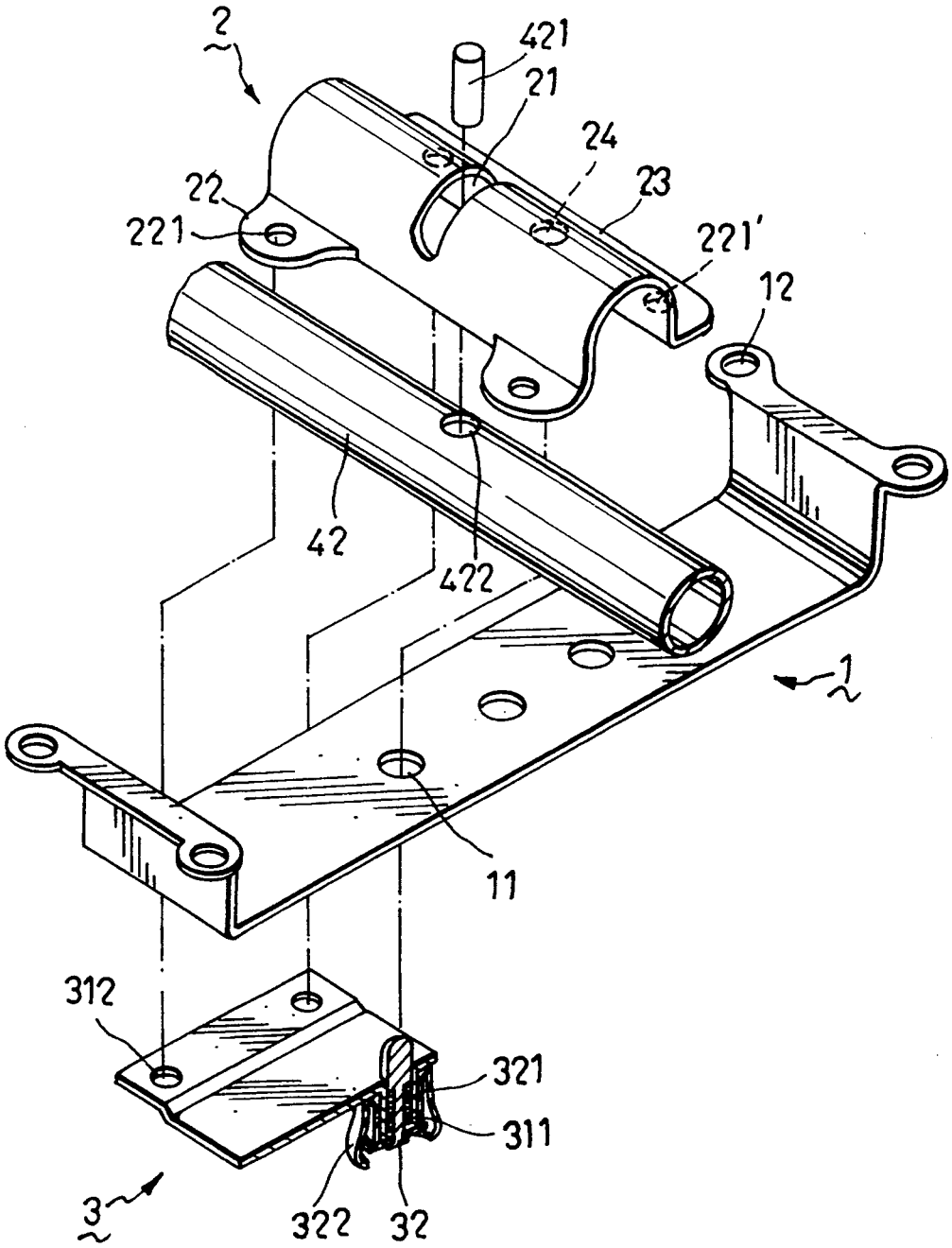
FIG. 2 PRIOR ART
FIG. 2 is an exploded view showing the height adjustment apparatus of the conventional baby walker.
Figure 3:
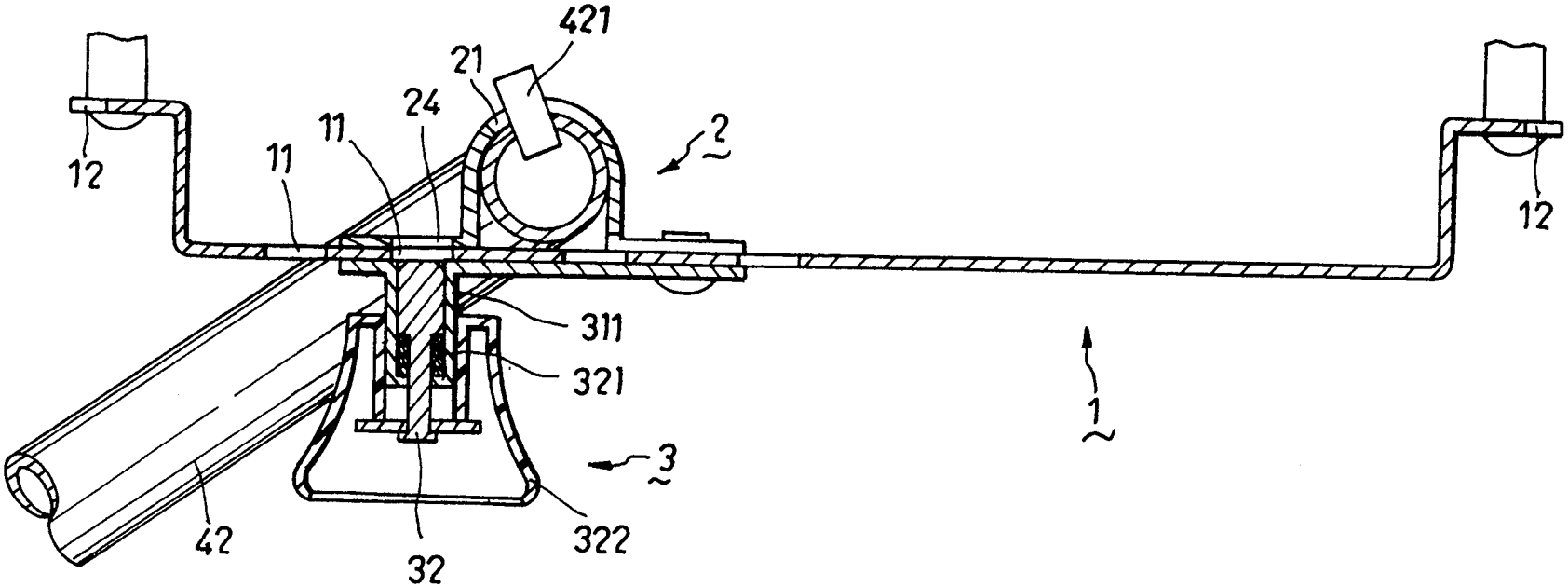
FIG. 3 PRIOR ART
FIGS. 3, 4 and 5 are sectional views illustrating the operation of the height adjustment apparatus of the conventional baby walker.
Figure 4:
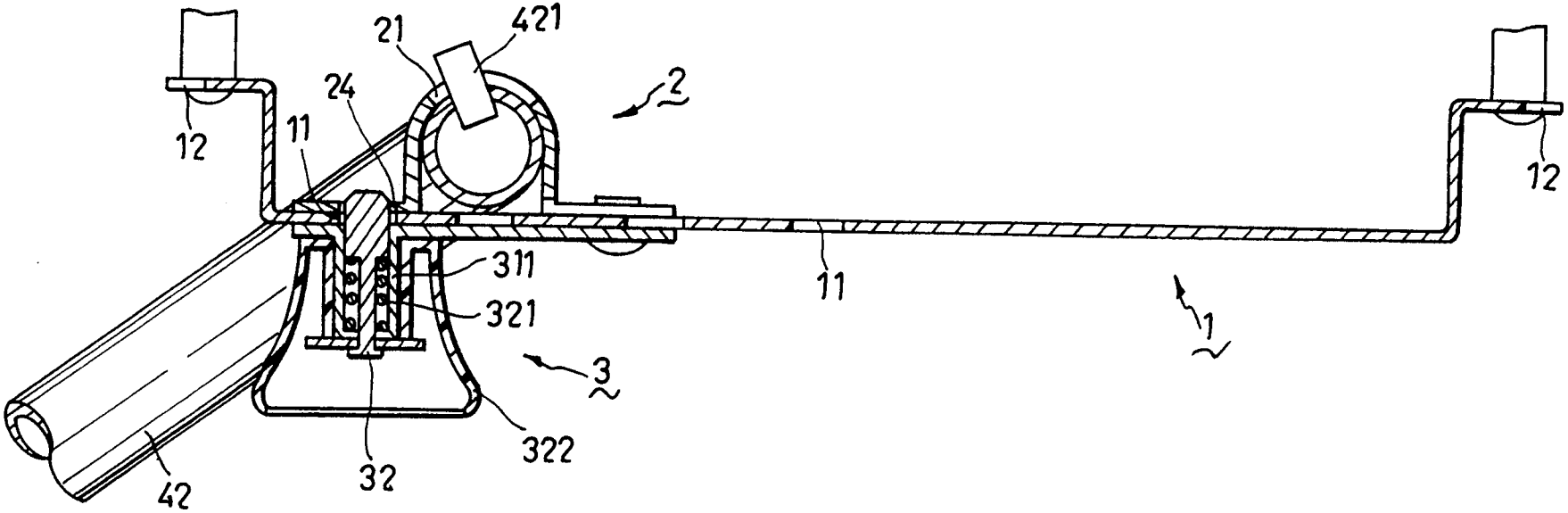
FIG. 4 PRIOR ART
Figure 5:
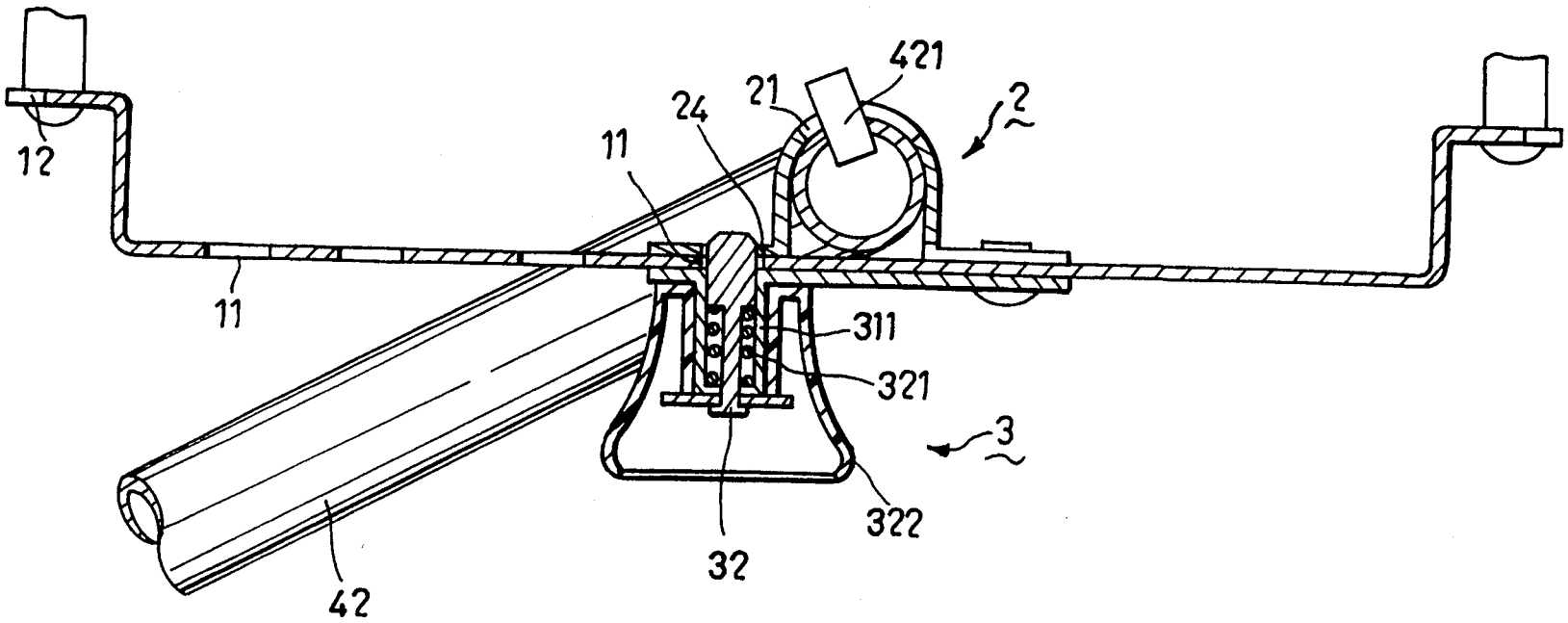
FIG.5 PRIOR ART
Figure 6:
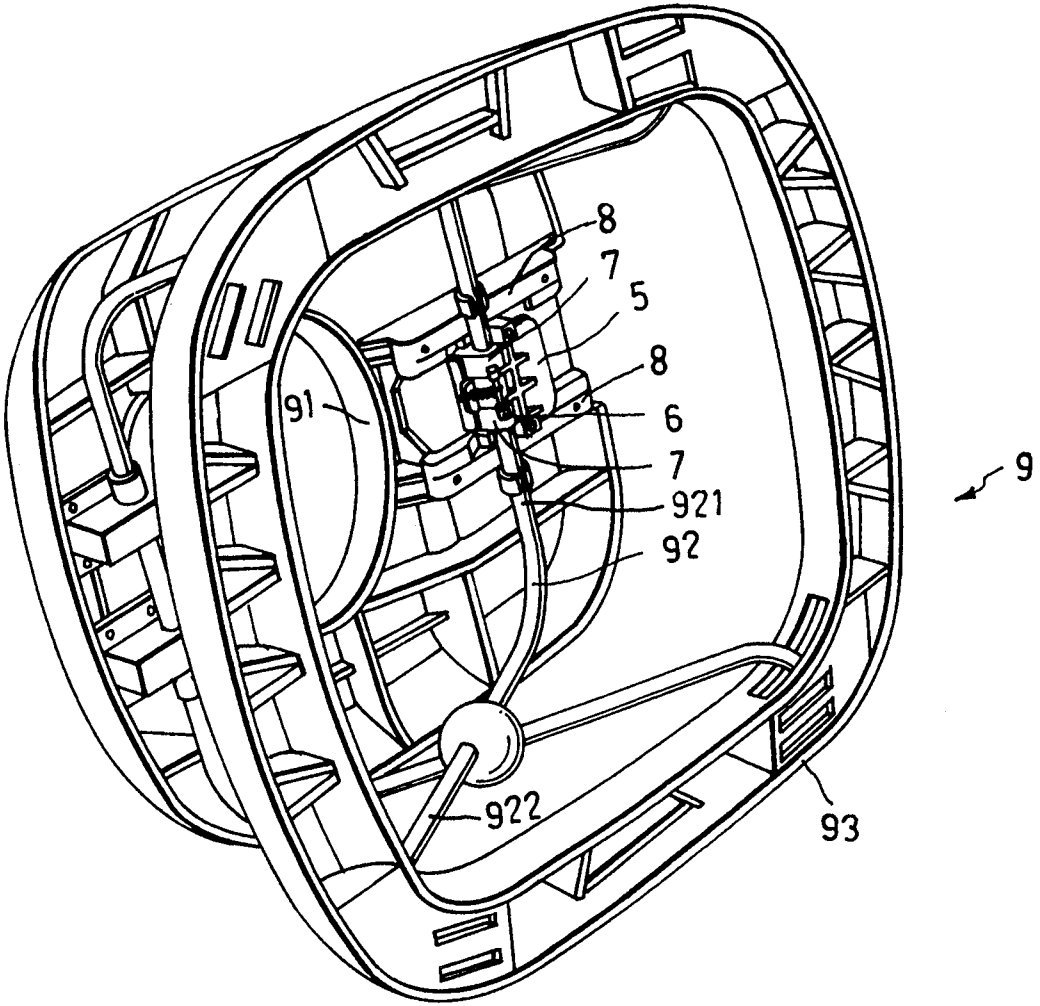
FIG. 6 is a perspective view of a baby walker having a double-lock height adjustment apparatus according to this invention.
Figure 7:
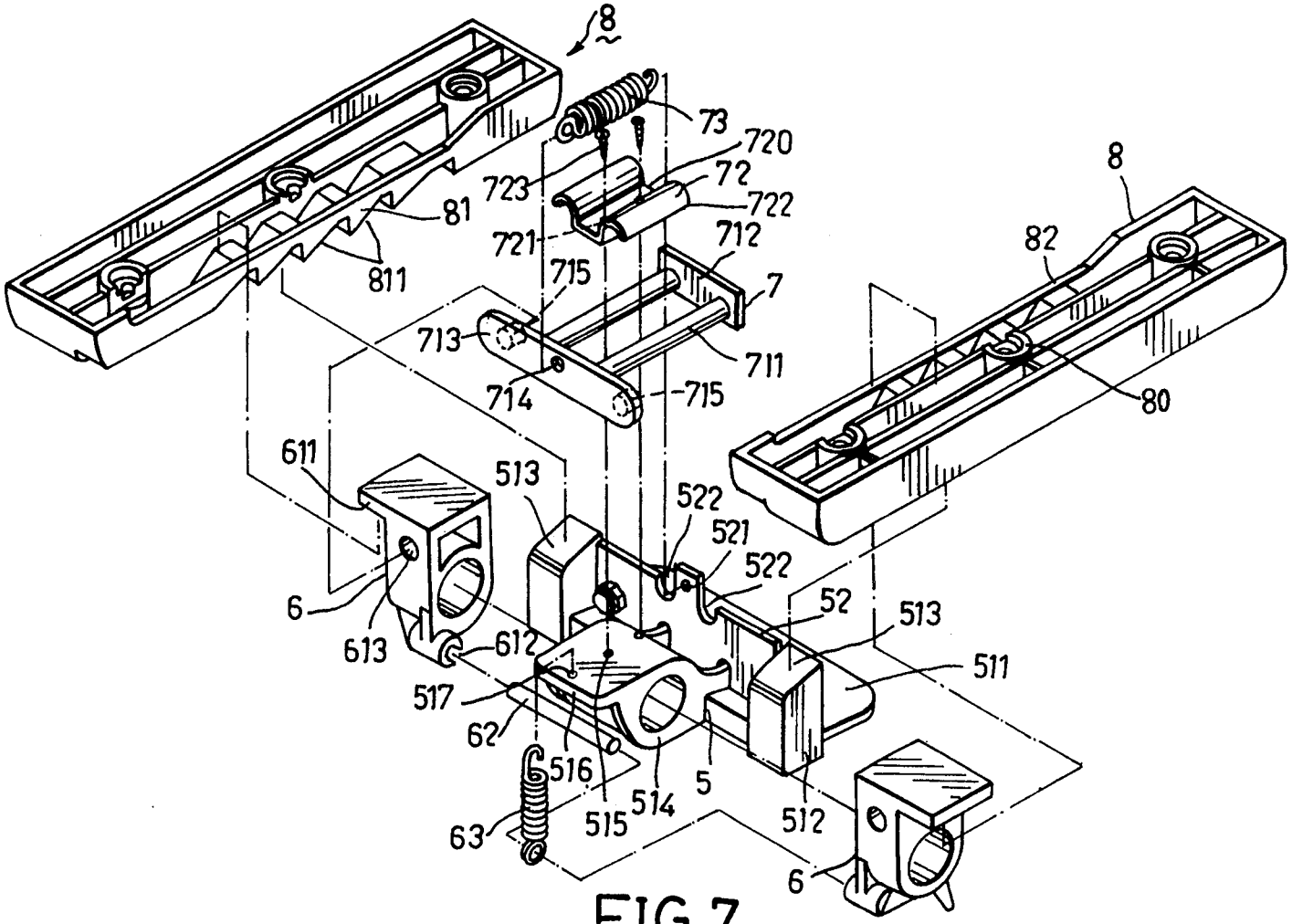
FIG. 7 is an exploded view showing the double-lock height adjustment apparatus of this invention.
Figure 8:
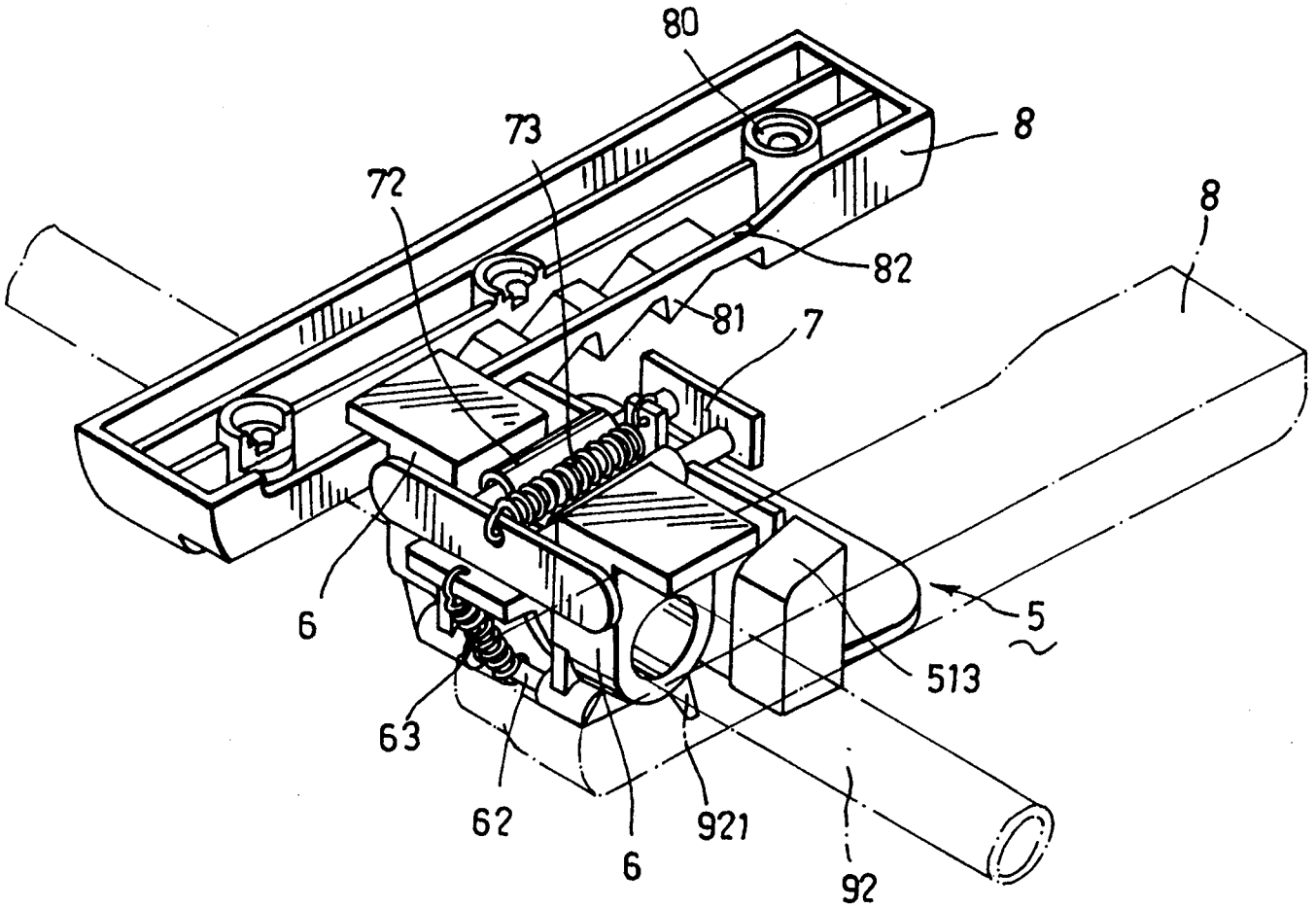
FIG. 8 is an assembled view showing the double-lock height adjustment apparatus of this invention.

Referring to FIGS. 6, 7 and 8, a double-lock height adjustment apparatus of this invention is used for a baby walker (9) which includes a seat (91), a slidable base member (93) and a U-shaped tube (92) having a central portion (921) that is coupled with the seat (91) and two parallel end portions that are pivoted to the base member (93).

The apparatus of this invention includes a first controlling member (5), two aligned lock elements (6), a second controlling member (7) and two aligned rack members (8).

Each of the rack members (8) has three fastener holes (80) formed therethrough so as to screw the rack member (8) to the underside of the seat (91), a toothed portion (81) with several teeth (811) projecting downward from the rack member (S), and a slide slot (82) formed in the upper end portion of a side wall of the rack member (8).

The first controlling member (5) has a sleeve portion (514) sleeved rotatably on the central portion (921) of the U-shaped tube (92), an operation plate (511) connected securely to the sleeve portion (514), and two engaging portions (512) connected securely to the operation plate (511). The engaging portions (512) have inclined upper end surfaces (513) respectively inserted into an adjacent pair of teeth (811) of the toothed portions (81) of the rack members (8). The sleeve portion (514) has two threaded holes (515) formed in the upper surface thereof, and a spring hole (516) formed therethrough. A guide plate (52) is disposed on the first controlling member (5) and includes two aligned notches (522) formed in the upper portion thereof, and a projection positioned between the notches (522) and having a hole (521) formed therein.

The lock elements (6) are sleeved on the central portion (921) of the U-shaped tube (92) on two sides of the sleeve portion (514) of the first controlling member (5). Each of the lock elements (6) includes a projecting plate (611) which projects from the upper end portion thereof, a slot (612) which is formed in the lower end portion thereof, and an engaging hole (613) which is formed in the intermediate portion thereof. A pin (62) is inserted into the slots (612) of the lock elements (6) at two ends thereof. A first spring (63) has a lower end fastened to the pin (62), and an upper end secured in the spring hole (517) of the first controlling member (5) so as to bias the engaging portions (512) of the first controlling member (5) to engage the toothed portions (81) of the rack members (8). Because each of the lock elements (6) abuts against one of the rack members (8) and the sleeve portion (514)-of the first controlling member (5), the lock elements (6) cannot slide relative to the U-shaped tube (92). Furthermore, the projecting plate (611) of each of the lock elements (6) extends into the slide slot (82) of the corresponding rack member (8) so as to prevent rotation of the lock elements (6) relative to the U-shaped tube (92). Accordingly, when the engaging portions (512) of the first controlling members (5) are removed from the toothed portions (81) of the rack members (8), the projecting plates (611) of the lock elements (6) can slide between the seat (91).

Figure 9:
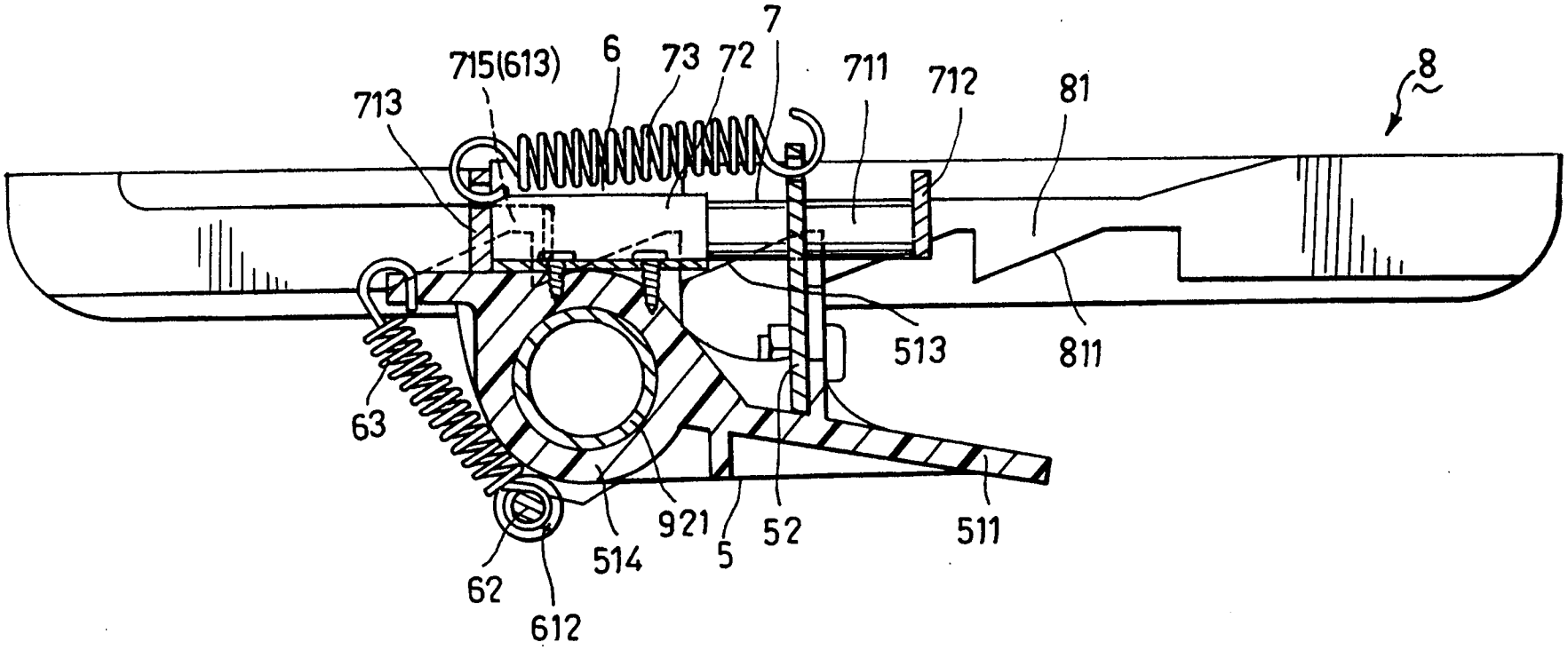
FIG. 9 is a schematic view illustrating how the height of the baby walker is fixed in accordance with this invention.

The second controlling member (7) consists of two parallel guide rods (711), a push plate (712) and a lock plate (713). Each of the guide rods (711) has a first end connected securely to the push plate (712), and a second end connected securely to the lock plate (713). A retaining sheet (72) has a planar middle portion (720) with two fastener holes (721) formed therethrough, and two curved wing portions (722) connected securely to two sides of the middle portion (720). Two screws (723) extend through the fastener holes (721) of the retaining sheet (72) to engage the threaded holes (515) so as to retain the second controlling member (7) on the first controlling member (5). Accordingly, the second controlling member (7) is slidable on the first controlling member (5). The lock plate (713) includes a spring hole (714) formed therethrough, and two engaging tongues (715) projecting inward from the lock plate (713). As best shown in FIG. 9, a second spring 73 has a first end secured in the spring hole (714) of the second controlling member (7), and a second end secured in the hole (521) of the first controlling member (5) so as to bias the engaging tongues (715) of the second controlling member (7) to engage the engaging holes (613) of the lock elements (6). Because the lock elements (6) cannot rotate relative to the U-shaped tube (92), the engagement of the engaging tongue (715) with the engaging holes (613) prevents rotation of the first and second controlling members (5, 7) relative to the U-shaped tube (92), thereby locking the engaging portions (512) of the first controlling member (5) on the toothed portions (81) of the rack members (8) to fix the height of the baby walker (9).

Figure 10:
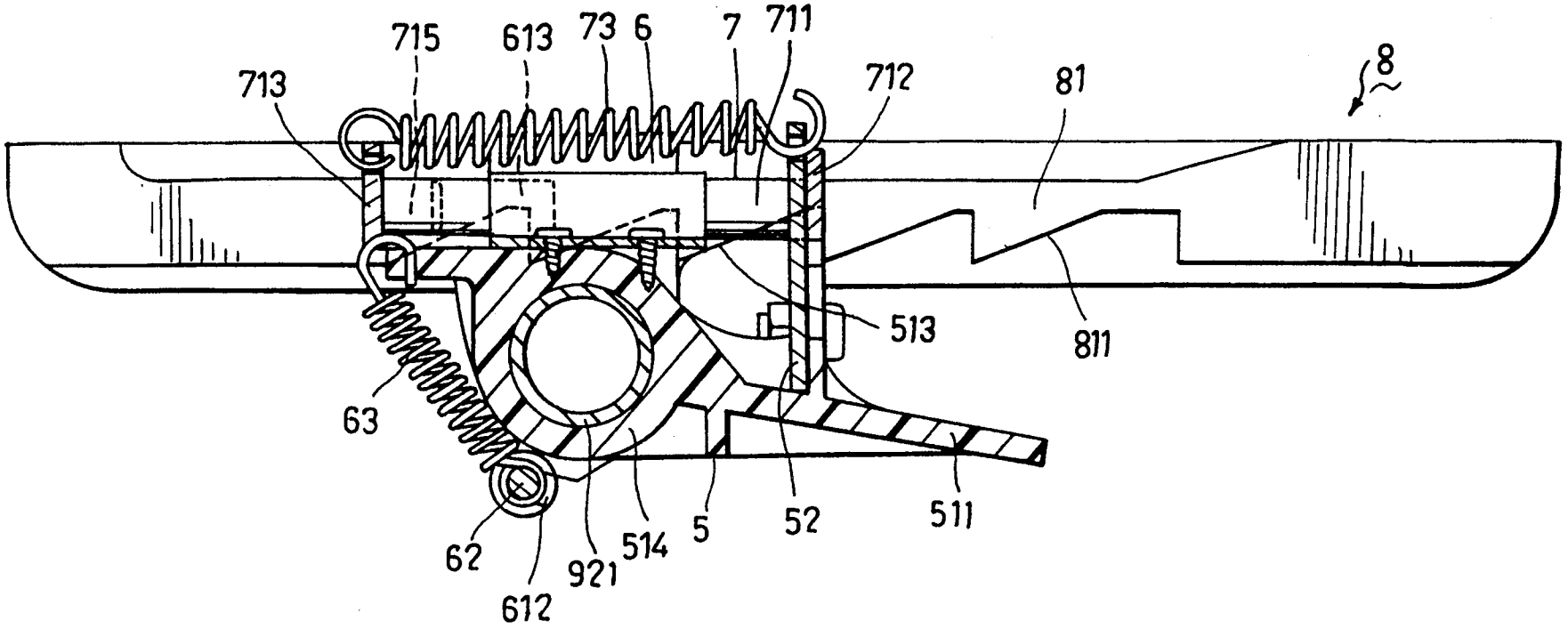
FIG. 10 is a schematic view illustrating the movement of the second controlling member of the height adjustment apparatus according to this invention.
Figure 11:
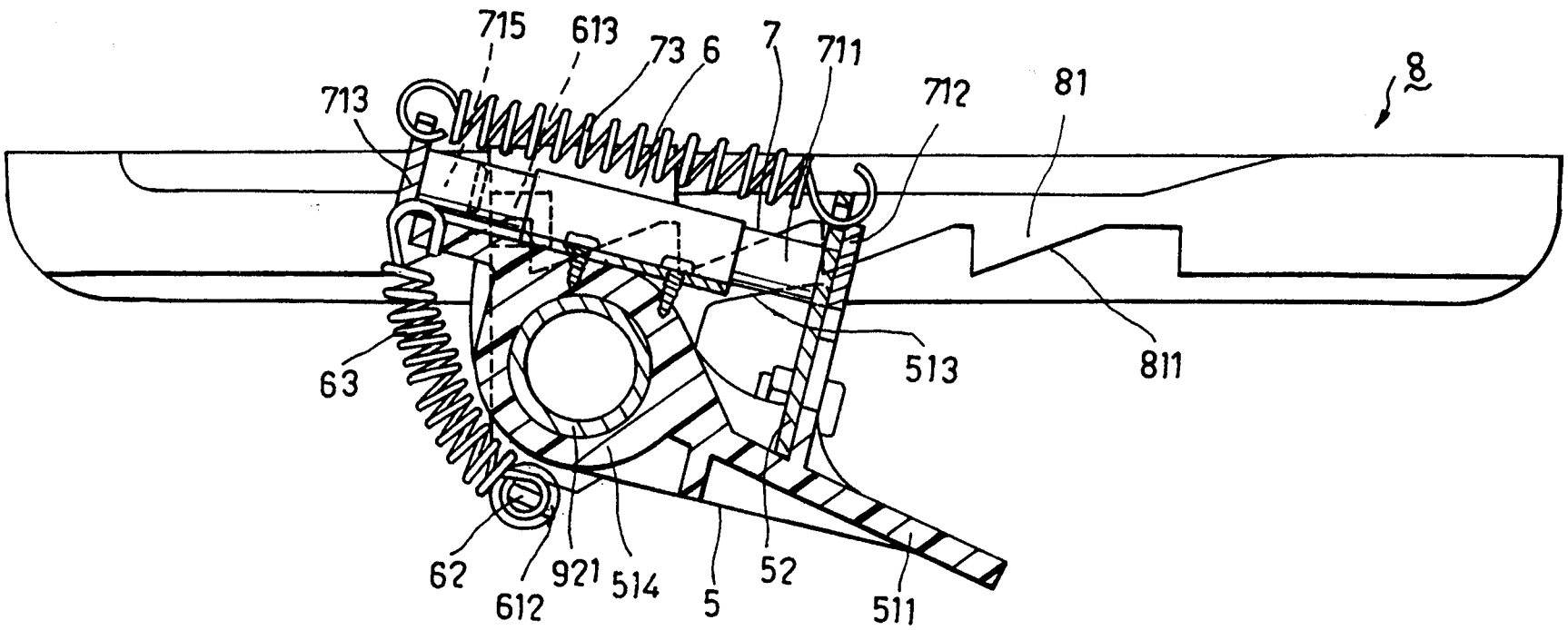
FIG. 11 is a schematic view illustrating the rotation of the first controlling member of the height adjustment apparatus according to this invention.

When it is desired to adjust the height of the baby walker (9), as shown in FIG. 10, the push plate (712) is pushed to disengage the engaging tongues (715) of the second controlling member (7) from the engaging holes (613) of the lock elements (6). Then, the operation plate (511) is depressed to rotate the first controlling member (5) about the U-shaped tube (92) to the position shown in FIG. 11, in which the engaging portions (512) of the first controlling member (5) separate from the toothed portions (81) of the rack members (8). At this time, the first controlling member (5) can be moved relative to the rack members (8) so as to move the U-shaped tube (92) relative to the seat (91). In this way, the position of the engaging portions (512) of the first controlling member (5) can be moved from one position on the toothed portion (81) to another so as to adjust the height of the baby walker (9).

As a safety precaution, the seat (91) can move relative to the slidable base member (93) only when both the push plate (712) and the operation plate (511) are actuated.

With this invention thus explained, it is apparent that numerous modifications and variations can be made without departing from the scope and spirit of this invention. It is therefore intended that this invention be limited only as indicated in the appended claims.

I claim:

1. A height adjustment apparatus for a baby walker, said baby walker including a seat, a slidable base member, and a U-shaped tube which has a central portion that is coupled with said seat and two parallel end portions that are pivoted to said base member, said height adjustment apparatus comprising:

two aligned rack members secured to an underside of said seat, each of said rack members having a bottom surface with a toothed portion;

a first controlling member having a sleeve portion sleeved rotatably on said central portion of said U-shaped tube, an operation plate connected securely to said sleeve portion, and two engaging portions connected securely to said operation plate and engaged with said toothed portions of a respective one of said rack members;

a first spring biasing said engaging portions to engage said toothed portions of said rack members;

two lock elements sleeved fixedly on said central portion of said U-shaped tube on two sides of said sleeve portion of said first controlling member, each of said lock elements having an engaging hole formed therein;

a second controlling member being mounted slidably on said first controlling member and having two engaging tongues projecting therefrom to engage said engaging holes of said locking elements, and a push plate being connected securely to said engaging tongues so as to prevent rotation of said first and second controlling members about said central portion of said U-shaped tube, said push plate being pushed to disengage said engaging tongues of said second controlling member from said engaging holes of said lock elements; and a second spring biasing said engaging tongues to engage said engaging holes of said lock elements respectively;

whereby, when said push plate is actuated to disengage said engaging tongues of said second controlling member from said engaging holes of said lock elements, depression of said operation plate disengages said engaging portions of said first controlling member from said toothed portions of said rack members so as to allow movement of said engaging portions of said first controlling member relative to said rack members, thereby adjusting the position of said U-shaped tube relative to said seat.

* * * * *